US006298909B1

(12) United States Patent
Fukatami et al.

(10) Patent No.: US 6,298,909 B1
(45) Date of Patent: Oct. 9, 2001

(54) HEAT EXCHANGE TUBE HAVING A GROOVED INNER SURFACE

(75) Inventors: Takao Fukatami; Tetsuya Furuuchi; Shin Kikuchi; Shunroku Sukumoda, all of Aizuwakamatsu (JP)

(73) Assignee: Mitsubishi Shindoh Co. Ltd., Tokyo (JP)

( * ) Notice: Subject to any disclaimer, the term of this patent is extended or adjusted under 35 U.S.C. 154(b) by 0 days.

(21) Appl. No.: 09/515,989

(22) Filed: Mar. 1, 2000

(51) Int. Cl.[7] ..... F28F 1/40
(52) U.S. Cl. ..... 165/133; 165/183
(58) Field of Search ..... 165/183, 179, 165/181, 133; 29/890.049, 890.053

(56) References Cited

U.S. PATENT DOCUMENTS 4,658,892 * 4/1987 Shinohara et al. ..... 165/133
5,791,405 * 8/1998 Takiura et al. ..... 165/184
5,803,165 * 9/1998 Shikazono et al. ..... 165/184
5,915,467 * 6/1999 Ishikawa et al. ..... 165/133
5,975,196 * 11/1999 Gaffancey et al. ..... 165/133
6,000,466 * 12/1999 Aoyagi et al. ..... 165/183
6,018,963 * 2/2000 Itoh et al. ..... 165/133
6,026,892 * 2/2000 Kim et al. ..... 165/133

* cited by examiner

*Primary Examiner*—Ira S. Lazarus
*Assistant Examiner*—Terrell McKinnon
(74) *Attorney, Agent, or Firm*—Kolisch Hartwell Dickinson McCormack & Heuser

(57) ABSTRACT

With a grooved-inner-surface heat transfer tube, an inner circumferential surface of a metal tube is formed with fins bent at bent portions in a zigzag and extending consecutively around a circumferential direction of the inner circumferential surface, and at at least a part of the bent portions of the fins, the height of the fins is set at 30 to 90% of the height of the fins excluding the bend portions. With such a heat transfer tube, pressure loss can be suppressed while increasing heat exchange performance.

5 Claims, 5 Drawing Sheets

HEAT EXCHANGE TUBE HAVING A GROOVED INNER SURFACE

BACKGROUND TO THE INVENTION

1. Field of the Invention

The present invention relates to a grooved-inner-surface heat transfer tube with fins for enhancing heat exchange efficiency formed in a zigzag shape on the inner surface of a metal tube.

2. Description of the Related Art

This type of grooved-inner-surface heat transfer tube is used mainly as an evaporator tube or a condenser tube in heat exchangers or the like in air-conditioners or cooling apparatus. Recently, heat transfer tubes formed with spiraling fins over the entire face of the inner surface have been widely marketed.

The heat transfer tubes which are currently most popular are manufactured by a method wherein fins are roll-formed over the entire inner surface of a metal tube by passing a floating plug formed with spiral grooves on the outer circumferential surface, along the interior of a seamless tube (with no joins) obtained by a drawing or an extrusion process.

In grooved-inner-surface heat transfer tubes formed with spiral fins of this type, heat transfer liquid which has collected to the bottom of the interior of the heat transfer tube is drawn up along the spiral fins by being blown by a vapor current flowing inside the tube, thereby spreading along the entire circumferential surface inside the tube. Due to this effect, the entire circumferential surface inside the tube is made almost uniformly wet, so that in cases where the tube is used as an evaporation tube for evaporating the heat transfer liquid, the area of the region where boiling occurs can be increased to improve the boiling efficiency. Additionally, in cases where the tube is used as a condenser tube for liquefying heat transfer gas, the condensation efficiency can be increased by increasing the contact efficiency between the metal surfaces and the heat transfer gas due to the tips of the fins being exposed from the surface of the liquid.

However, it is apparent that there is room for further improvement of the effect of increased heat transfer efficiency due to the spiral fins. It is for this reason that the inventors of the present invention have applied electric resistance welding processing methods for the manufacture of heat transfer tubes and have produced many types of grooved-inner-surface heat transfer tubes by changing the patterns of the grooves in the heat transfer tubes, and then carried out experiments to compare their performance. As a result, they discovered that better heat transfer performance can be obtained in comparison to simple spiral patterns and the like, if multiple fins are formed extending in a zigzag pattern around the circumferential direction of the inner surface of the heat transfer tubes.

However, in cases where this type of zigzag patterned fins were formed, there was another problem of a substantial pressure loss due to fluid resistance applied to the fluid when the fluid flows over the bend portions of each of the fins having a convex shape toward the downstream direction.

In order to alleviate this increase in pressure loss, a trial was made involving forming a gap in each of the bend portions of the zigzag patterned fins to have the fluid flow through each of the gaps. However, while there was some reduction in the pressure loss, heat exchange efficiency decreased markedly, so that there arose the problem of not being able to obtain the high heat exchange efficiency of the conventional zigzag patterned fins.

SUMMARY OF THE INVENTION

The present invention takes into consideration the aforementioned situation, with the object of providing a grooved-inner-surface heat transfer tube where pressure loss can be suppressed while increasing heat exchange performance.

In order to achieve this object, with a grooved-inner-surface heat transfer tube according to the present invention, an inner circumferential surface of a metal tube is formed with fins bent at bend portions in a zigzag and extending consecutively around a circumferential direction of the inner circumferential surface, and at at least a part of the bend portions of said fins from said inner circumferential surface is set at 30 to 90% of a height of said fins excluding said bend portions.

According to the grooved-inner-surface heat transfer tube of the present invention, fins are formed bent in a zigzag and extending consecutively around a circumferential direction of the inner circumferential surface, and at at least a part of the fin bend portions the height of, the p inner circumferential surface is set at 30 to 90% of the height of the fins excluding the fin bend portions. Therefore, even at times when the fluid flowing inside the heat transfer tube flows into and collects in the trough side of the fin bend portions, the fluid flows easily over the low fin bend portions so that there is no occurrence of high fluid resistance at the fin bend portions. Moreover, compared with constructions in which gaps are formed in the fin bend portions, as a result of the fluid flowing over the fin bend portions an effective stirring of the fluid takes place whereby there is little incidence of the usual high loss of heat exchange efficiency of zigzag shaped fins. Accordingly, it is possible to effect a well balanced result of reducing pressure loss while increasing heat exchange efficiency which in the past has been difficult to achieve.

DESCRIPTION OF THE PREFERRED EMBODIMENTS

Figure 1:
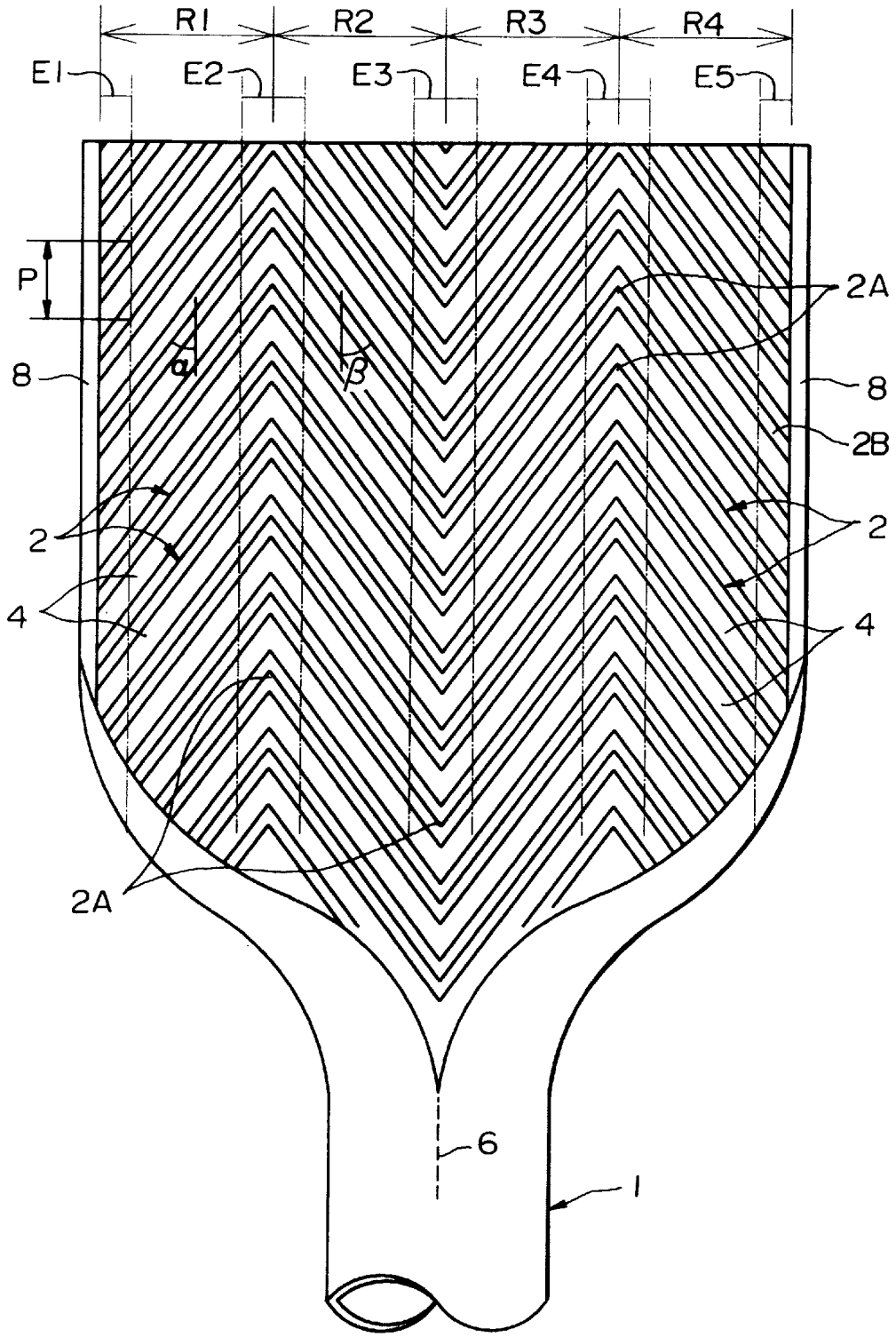
FIG. 1 is plan view of an embodiment of a grooved-inner-surface heat transfer tube according to the present invention, with an inner surface partially spread open.

FIG. 1 is a partially spread open plan view of a first embodiment of a grooved-inner-surface heat transfer tube according to the present invention. This grooved-inner-surface heat transfer tube 1 is generally made of metals such as copper, copper alloy, aluminum and aluminum alloy or the like. A plurality of parallel fins 2 which extend in zigzag fashion in the circumferential direction are formed on the inner circumferential surface of the grooved-inner-surface heat transfer tube 1, with grooves 4 of a predetermined width formed between the fins 2.

Figure 2:
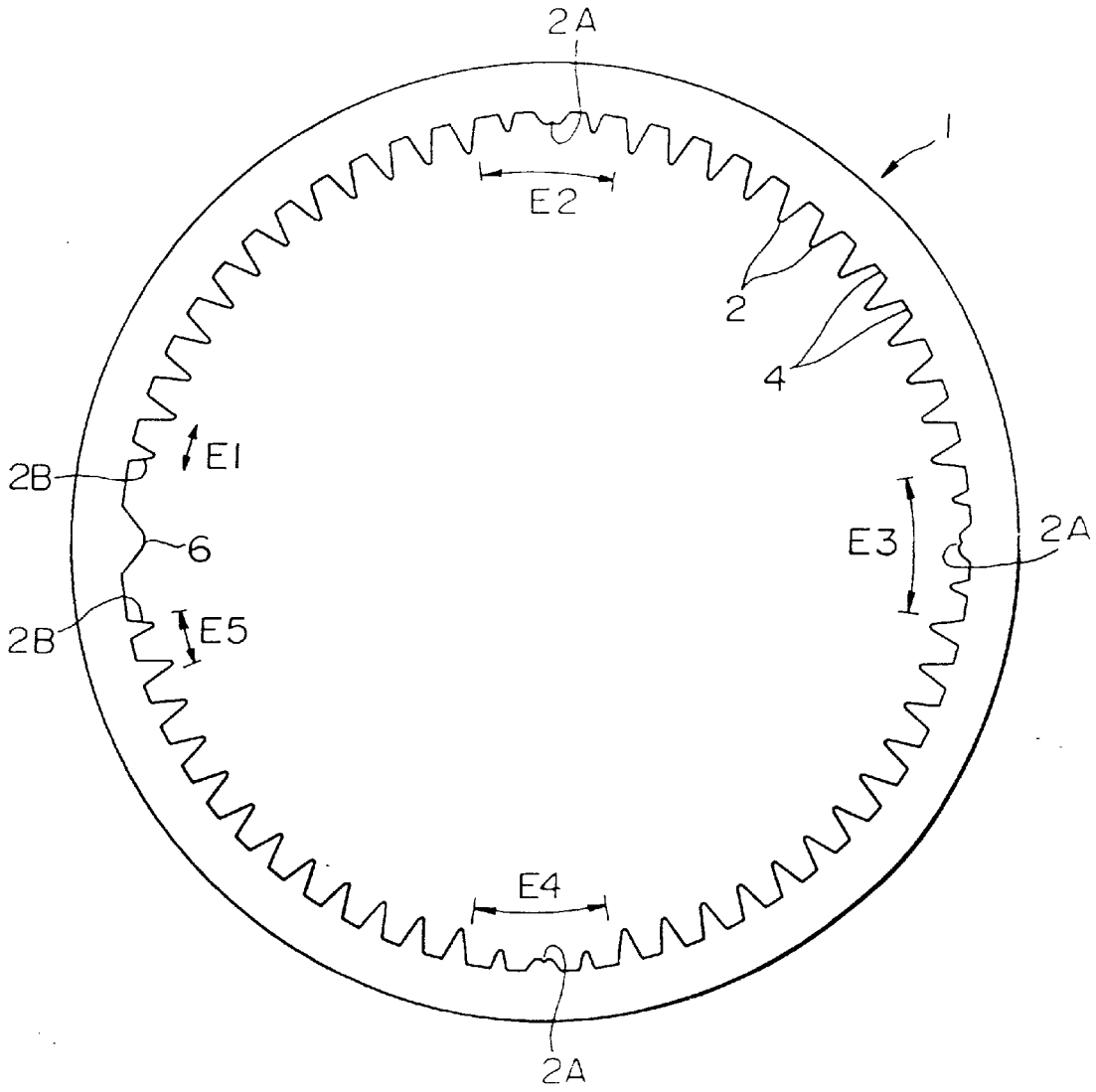
FIG. 2 is a sectional view of the embodiment of FIG. 1.

FIG. 2 is a sectional view perpendicular to the tube axis of the metal tube. As shown in FIG. 2 on the inner circumferential surface of the grooved-inner-surface heat transfer tube 1 a single weld line 6 is formed along the entire length extending along the direction of the tube axis and also protruding in inwards direction. On opposite sides of this weld line 6 there are formed parallel grooveless portions 8 of a pre-determined width, and this is where the fins 2 are parted. These grooveless portions 8 are desirable in order to make the density of the welding current generated at the edge surfaces of the strip material, uniform when the strip material is made into a tube by electrical seam welding. So that the weld line 6 does not obstruct a tube expansion process which involves passing an expander plug through the heat transfer tube 1, then preferably this protrudes with a protrusion amount less than that of the fins 2.

As shown in FIG. 1, the inner circumferential surface of the grooved-inner-surface heat transfer tube 1 of this embodiment is divided into four regions R1 to R4 of approximately equal width consisting of four bands at approximately every 90° in the circumferential direction. Counting from any one of these regions (in this case R1), at the odd numbered regions R1 and R3, the fins 2 are formed so as to make a positive angle $\alpha$ with respect to the axis of the heat exchanger tube, whereas at the even numbered regions R2 and R4 the fins 2 are formed so as to make a negative angle $\beta$ with respect to the axis of the heat exchanger tube. The positive and negative inclination angles $\alpha$ and $\beta$ may be reversed. In short either is acceptable provided they are inclined alternately in opposite directions with respect to the heat transfer tube axis each pre-determined length, so that the fins 2 form an overall zigzag pattern.

As for the fins 2 shown in FIG. 1, while the fins within the same region are mutually parallel, it is not absolutely necessary for them to be parallel, and it is acceptable to vary the inclination angles between the fins 2, or for the angles of $\alpha$ and $\beta$ to be different. The widths of the regions R1 to R4 may be unequal, and may be different from one another.

A main characteristic of this embodiment is that for the fin bend portions 2A and the fin end portions 2B positioned on the border line between each of the regions R1 to R4, in other words the regions E1 to E5 shown in FIG. 1 and FIG. 2, the height of the fins 2 from the inner circumferential surface of the metal tube is made smaller than the height of the fins excluding the fin bend portions 2A and the fin end portions 2B.

Figure 3:
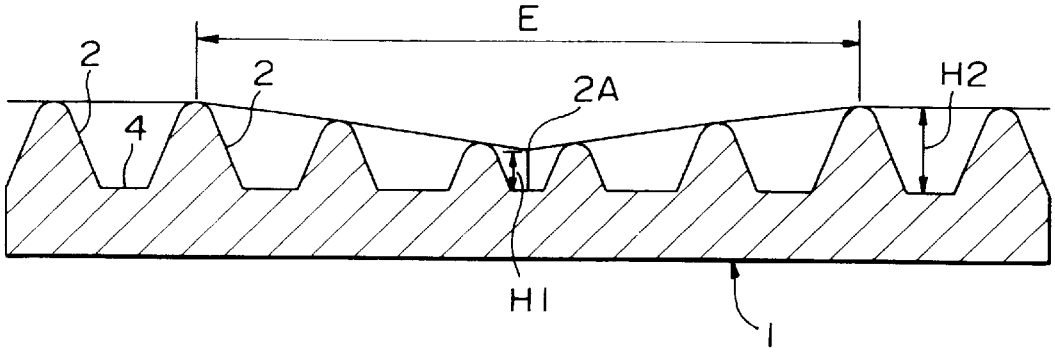
FIG. 3 is an enlarged sectional view showing the fin bend portions of the embodiment.

FIG. 3 is a sectional view of a fin bend portion 2A seen in the tube axis direction. For this fin bend portion 2A, the height of the fins gradually reduces as they approach the center line from opposite sides of the fin bend portion 2A, and at the position where they intersect the border lines between each of the regions R1 to R4 the height of the fins reaches its minimum. The minimum value H1 of the height of the fins for each region E1 to E5 is set at between 30 to 90% of the fin height H2 excluding the bend portions 2A and the fin ends 2B, and in particular it is even more preferable if this is set at between 50 to 70%. If the minimum value H1 is smaller than 30% of fin height H2 the reduction in heat exchange efficiency is market, an if more than 90% it becomes difficult to sufficiently reduce pressure loss. The same applies for the fin ends 2B.

Preferably the width E of each of the regions E2 to E4 is between 10 to 50% of the inner circumference of the tube. This is because, if the width is less than 10% it is difficult to sufficiently reduce the pressure loss, and if more than 50% heat exchange directions of the regions E1 and E5 to be no more than half the width E in the circumferential directions of the regions E2 and E4.

With this embodiment, the fin height of the fins 2 in the regions E1 to E5 is made relatively low. However, localized lowering of the fin height may be made at only the fin bend portion 2A excluding the fin end portions 2B, that is in the regions E2 to E4 only. With this embodiment due to the presence of the grooveless portions 8 the fin end portions 2B are not connected. Therefore the effect on the pressure loss of fin end portions 2B is comparatively small.

The reason for localized lowering of the fin height is to facilitate the flow of the fluid over the through parts of the bend portions 2A of the fins 2. Therefore, in cases where the fluid flows from de upper part to the lower part as seen in FIG. 1, lowering may be done at only E1, E3 and E5 (E3 only is acceptable), and in cases where the fluid flows from the lower part towards the upper part as seen in FIG. 1, lowering may be done in only E2 and E4. Furthermore, instead of lowering all of the fin bend portions in each of the regions E1 to E5, for example only every other fin bend portion along the direction of the tube axis may be lowered.

With this embodiment, the thickness of the metal tube in regions E1 to E5 is set at the same thickness as the metal tube at places corresponding to parts excluding these parts. As a result, the rigidity of the metal tube wall in the regions E1 to E5 is the same as the rigidity of the metal tube wall at other parts, thus having the advantage that tube expansion can be effected uniformly.

Figure 4:
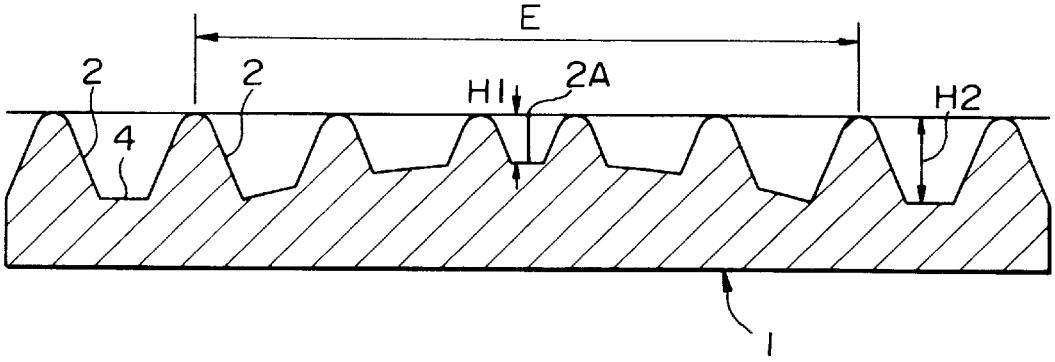
FIG. 4 is an enlarged sectional view showing the fin bend portions of a modified example the embodiment.

However, the present invention is not restricted to this construction, and as shown in FIG. 4, the thickness of the metal tube in regions E1 to E5 may be greater than the thickness of the metal tube at the place corresponding to the parts excluding these parts. In this case, it is easy to arrange the apex position of the fins 2 on a cylindrical face parallel with the outer circumferential surface of the heat transfer tube 1. Here this has the advantage that the contact condition of the tube expansion plug with the fins 2 is uniform.

Although the absolute values of the inclination angles $\alpha$ and $\beta$ of the fins 2 with respect to the tube axis are not limited, in general preferably these are between 8 to 30°, and even more preferably between 10 to 25°. If the absolute value exceeds 30° to fins 2 come close to being perpendicular with respect with the flow and this is not desirable because it obstructs the flow and increases the pressure loss. Additionally, if the absolute angle is less than 8°, the fins 2 come close to being parallel with respect to the flow so that the turbulence generating effect of the fins 2 is reduced.

The cross-sectional shape of the fins 2 may be shape, such as a triangle shape, as isosceles triangle shape, a triangle shape with a round chamfered apex, a semi-circular shape, a circular arc shape, a trapezoidal shape or a chamfered trapezoidal shape.

Although in the present invention the tubes axis direction pitch (P in FIG. 1) and the height H2 of the fins 2 are not restricted, in the case of typical grooved-inner-surface heat transfer tubes the pitch P of the fins 2 is preferably 0.1 to 0.6 mm, and more preferably 0.3 to 0.45 mm. Additional, the height of the fins H2 is preferably 0.01 to 0.50 mm, and more preferably 0.15 to 0.30 mm.

In cases where fin shapes are adopted with a narrower pitch and greater height than is conventional, it has become clear from the experiments conducted by the inventors of the present invention that the turbulence generation effect of the fins 2 is favorable, enabling an improvement in the heat exchange efficiency of the grooved-inner-surface heat transfer tube 1. Furthermore, with such thinner and taller fins 2, even at times when the inner surface of the grooved-inner-surface heat transfer tube 1 is covered in heat transfer fluid, because the draining ability at the tip portions of the fins 2 is good, then in the case where the tube is used as a condenser tube, direct contact of the metal surface at the tip portions of the fins 2 with the heating medium is facilitated. Hence favorable condensation performance can be obtain. On the other hand, in the case where a tall fin shape was adopted, the pressure loss at the fin bend portion was significant, making the results of the present invention remarkable.

The angle (apex angle) between the side surfaces of the fins 2 is not restricted by the present invention, and preferably in 10 to 30° and more preferably is 15 to 25°. In the case where the apex angle of the fins 2 is small in this way, the side surfaces of the fins 2 stand almost vertically upright from the inner circumferential surface of the tube. Therefore the effect of the fins 2 stirring the flow of the fluid and causing turbulence is increased. Despite this, as a result of forming the regions E1 to E5 where the fin height is low, an increase in pressure loss can be avoided. Furthermore, in the case where the apex angle of the fins 2 is small like this, when used as a condensation tube there is a high tendency for the individual tip portions of the fins 2 to be exposed. Hence the contact area of the heating medium and the metal surface is increased, enabling high condensation efficiency to be obtained.

The dimensions of the outer diameter, thickness, length and the like of the grooved-inner-surface heat transfer tube 1 are not restricted, and the present invention can be applied to heat transfer tubes of any dimensions conventionally used. While in general copper or copper alloy are used as the material for the grooved-inner-surface heat transfer tube 1, the present invention is not restricted to these as it is possible to use various kinds of metal such as aluminum and aluminum alloy. Additionally, while the cross-sectional shape of the heat transfer tube 1 of this embodiment is circular, the present invention is not restricted to having a circular cross-section, and as required, may have an oval cross-section or be a flattened tube shape. Furthermore, it is also effective to place working fluids such as pure water, alcohol, fluorocarbons and mixed solvents inside the groove-inner-surface heat transfer tube 1 under low pressure, close both ends of the tube and then use this as a heat pipe.

With the grooved-inner-surface heat transfer tube 1 constructed as described above, the fins 2 are formed bent in a zigzag and extending consecutively around the circumferential direction of the inner circumferential surface, and at the bend portions 2A of these fins the height H1 of the fins from the inner circumferential surface is set at 30 to 90% of the height H2 of the fins excluding the bend portions 2A. Therefore, even at times when the fluid flowing inside the heat transfer tube 1 flows into and collects at the fin bend portions 2A, the fluid can flow over the fin bend portions 2A so that here is no occurrence of high fluid resistance at the fin bend portions 2A. Moreover, compared with constructions in which cuts are formed in the fin bend portions, as a result of the fluid flowing over the fin bend portions 2A, an effective stirring of the fluid takes place whereby there is little incidence of the usual high loss of heat exchange efficiency of zigzag shaped fins. Accordingly, it is possible to effect a well balanced result of reducing pressure loss while increasing heat exchange efficiency, which in the past has been difficult to achieve.

Figure 5:
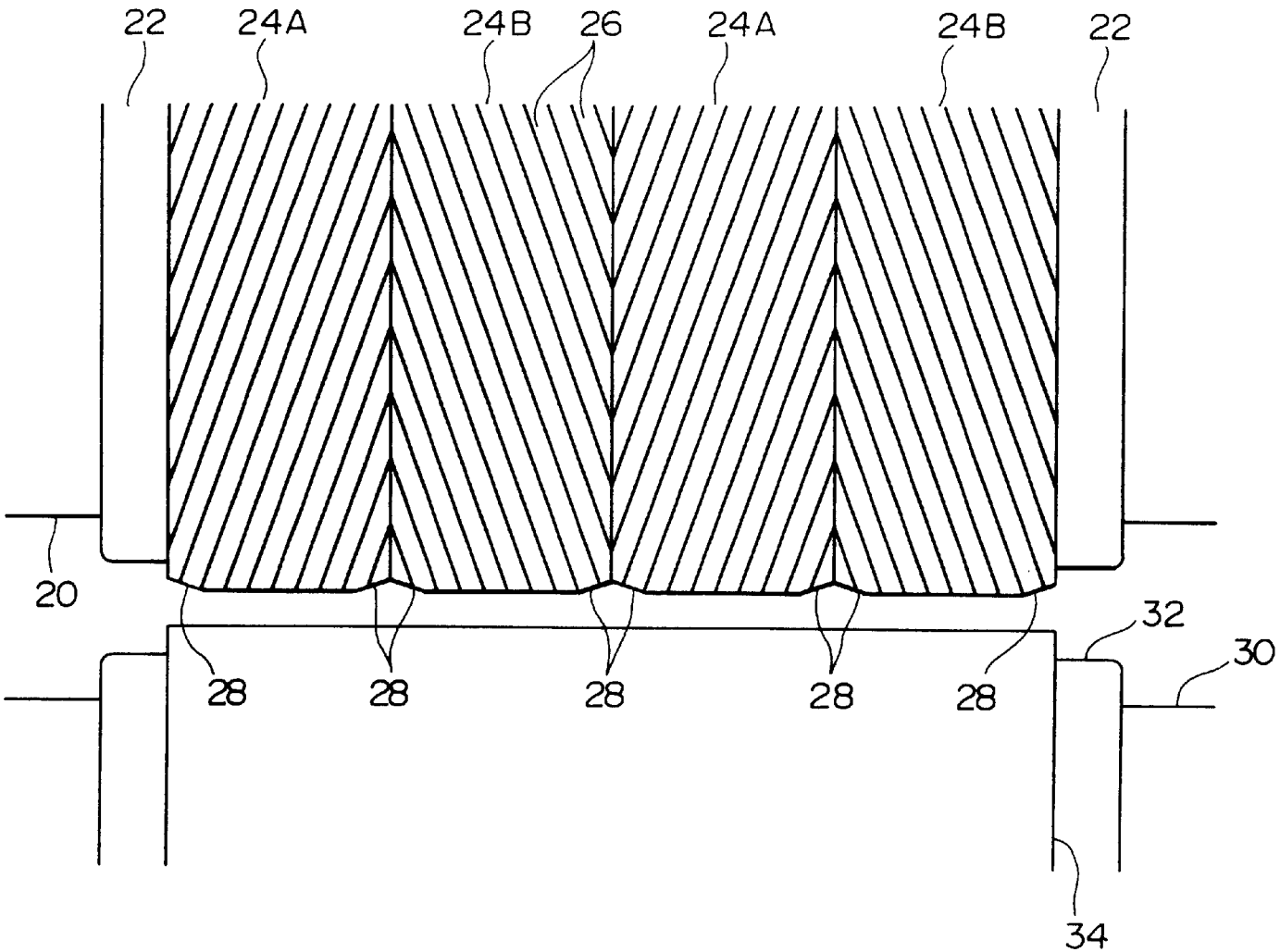
FIG. 5 is a front view showing the main parts of a roller device for the manufacture of the embodiment in FIG. 4.

As for the manufacture of the grooved-inner-surface heat transfer tube 1, after using for example a groove processing device as shown in FIG. 5 to roll the fins 2, the grooved portions 4, and the grooveless portions 8 on one side of a metal strip, the metal strip may be rounded into a tubular shape using a known seam welding processing device, and the abutted edge pairs welded. As a result of this welding, the welding line 6 is formed on the inner surface of the heat transfer tube 1.

The groove processing device in FIG. 5 comprises a grooved roller comprising four grooved rollers 24A, 24B fixed to a shaft member 20 by means of a pair of flanges 22, and a grooveless roller positioned opposite the grooved roller, and fixed to a shaft member 30 by means of a pair of flanges 32. By passing the metal strip between the grooved rollers 24A, 24B and the grooveless roller 34, the fins 2 are formed.

On the outer circumferential surface of the grooved rollers 24A, 24B there are formed parallel, spiral shaped fin forming grooves 26 for the purpose of rolling the fins 2. These fin forming grooves 26 are positioned so that they have plane symmetry with the interface of the grooved rollers 24A, 24B as the boundary. Opposite end portions 28 of the grooved rollers 24A, 24B are chamfered so that the outer diameter becomes slightly smaller the closer to the opposite ends. As a result, it is possible to form the regions E1 to E5 which have a cross-sectional shape as shown in FIG. 4. In order to obtain the cross-sectional shape shown in FIG. 3, instead of forming the chamfered portions 28, the depth of the fin forming grooves 26 at the opposite end portions of the grooved rollers 24A, 24B may be made smaller.

Figure 6:
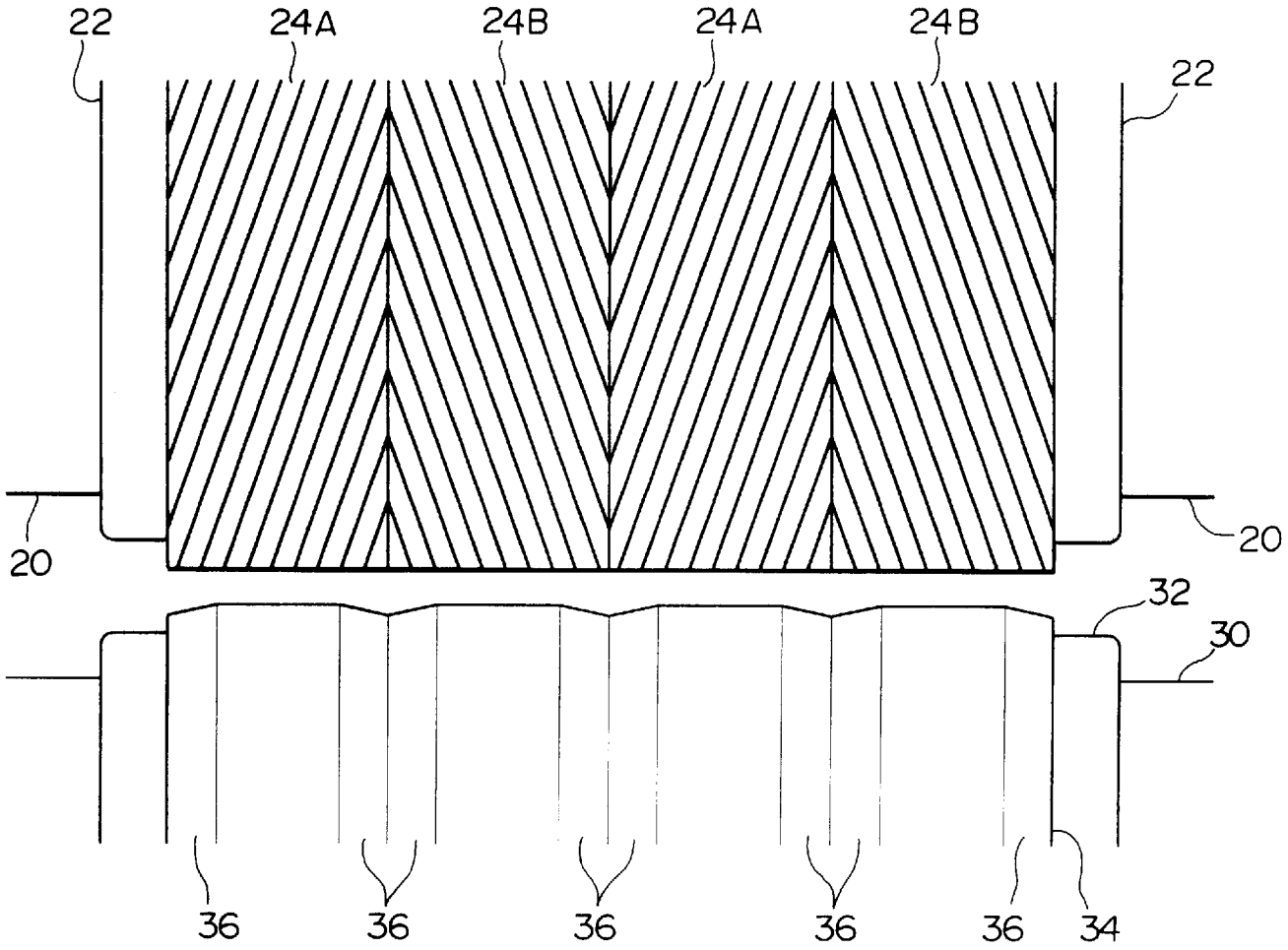
FIG. 6 is a front view showing the main parts of the roller device for the manufacture of the embodiment in FIG. 4.

Furthermore, as for an other manufacturing method, as shown in FIG. 6 instead of forming chamfered portions 28 on the grooved rollers 24A 24B, shallow cross-sectional V-shaped concave portions 36 may be formed around the entire circumference of the outer circumferential surface of the grooveless roller 34. By means of these concave portions 36 the draft at the boundary of the grooved rollers 24A, 24B can be decreased, and the height of the fins 2 reduced. In this case also a cross-sectional shape as shown in FIG. 4 is obtained.

Moreover, as for another manufacturing method, using a metal strip that has been pre-thinned along its whole length at places corresponding to the regions E1 to E5, rolling is performed with the grooved rollers 24A, 24B which do not have a chamfered portion 28, and the grooveless roller 34 which does not have concave portions 36, so that only the draft at the thinned parts is controlled, and the height of the fins 2 for the regions E1 to E5 lowered.

With the aforementioned embodiments, the number of fin bends has been set at four, one for each of the regions R1 to R4 around the circumferential direction of the inner face of the grooved-inner-surface heat transfer tube 1. However, the region may be divided into two or six regions in the circumferential direction, and the number of fin bends made two or six. In all of these cases the same results as for the first embodiment are obtained. Furthermore, in the case where the outer diameter of the heat transfer tube is large, it is possible to divide the inner circumferential surface of the heat transfer tube into eight or more regions (which would give eight fin bends).

What is claimed is:

1. A grooved inner-surface heat transfer tube wherein an inner circumferential surface of a metal tube is formed with fins bent at bend portions in a zigzag and extending consecutively around a circumferential direction of said inner circumferential surface, at at least a apart of said bend portions of said fins, a height of said fins from said inner circumferential surface is set at 30% to 90% of a height of said fins excluding said bend portions, and wherein a width, in a circumferential direction of said metal tube, of each region in winch said height of said fins is relatively reduced is between 10% and 50% of an inner circumference of said metal tube.

2. A grooved-inner-surface heat transfer tube according to claim 1, wherein a thickness of said metal tube at a location corresponding to said fin bend portions is the same as a thickness of said metal tube at a location corresponding to portions excluding said fin bend portions.

3. A grooved-inner-surface heat transfer tube according to claim 1, wherein a thickness of said metal tube at a location corresponding to said fin bend portions is greater than a thickness of said metal tube at a location corresponding to portions excluding said fin bend portions.

4. A grooved-inner-surface heat transfer tube according to claim 1, wherein the number of bends of said fins is any of 2, 4 and 6 around the circumferential direction of said metal tube.

5. A grooved inner-surface heat transfer tube according to claim 1, wherein the width, in a circumferential direction of the metal tube, of each region in which the height of the fins is relatively reduced is between 10% and 50% of the inner circumference of the metal tube.

* * * * *